United States Patent [19]

Goloff

[11] 4,077,751

[45] Mar. 7, 1978

[54] END HOUSING CLAMPS FOR ROTARY MECHANISMS

[75] Inventor: Alexander Goloff, East Peoria, Ill.

[73] Assignee: Caterpillar Tractor Co., Peoria, Ill.

[21] Appl. No.: 573,670

[22] Filed: May 1, 1975

[51] Int. Cl.[2] ..... F01C 21/10; B65D 45/02

[52] U.S. Cl. ..... 418/270; 292/256.61; 292/256.73; 418/61 A

[58] Field of Search ..... 418/60, 61 R, 61 A, 418/61 B, 270; 415/196, 200, 201; 123/8.45; 292/256, 256.73, 256.71, 256.61

[56] References Cited

U.S. PATENT DOCUMENTS

| | | | |
|---|---|---|---|
| 2,784,673 | 3/1957 | Mamur | 415/201 X |
| 3,400,692 | 9/1968 | Jones | 123/8.07 |
| 3,513,814 | 5/1970 | Jones | 123/8.45 |
| 3,819,297 | 6/1974 | East | 415/201 X |

*Primary Examiner*—Carlton R. Croyle
*Assistant Examiner*—Leonard Smith
*Attorney, Agent, or Firm*—Wegner, Stellman, McCord, Wiles & Wood

[57] ABSTRACT

An improved rotary mechanism such as a rotary engine, and, more specifically, an improved clamp for securing the center and end housings of such mechanisms together. The improved clamping means include at least one elongated bracket having a convex face when unstressed, with the convex face being in contact with the side of one of the end housings opposite from the center housing. Bolts are employed to stress the clamping bracket to bring the convex face into contact with the end housing side along most of the length of the face to eliminate localized stress.

5 Claims, 3 Drawing Figures

END HOUSING CLAMPS FOR ROTARY MECHANISMS

BACKGROUND OF THE INVENTION

This invention relates to rotary mechanisms, and, more particularly, to improved clamping means for clamping the end housings of such mechanisms to the center housing, particularly in so-called "crowded" areas such as where ports, ignition devices, fuel injection devices, or the like are located. Prior art of relevance includes the following U.S. Pat. Nos. 3,513,814 to Jones, issued May 26, 1970; and 3,400,692 to Jones, issued Sept. 10, 1968.

A typical rotary mechanism, such as a rotary engine, compressor, or pump, or the like, has an operating chamber defined by a center housing flanked by a pair of end housings. In a typical construction, the end housings are clamped to the center housing by means of bolts extending through both end housings as well as the center housing.

Bolt spacing must be reasonably close to avoid gas leakage and to prevent structural failures of the housings themselves. In addition, where a coolant is used, the bolt spacing must be sufficiently close as to prevent coolant leakage.

In a typical engine, there are instances where bolt spacing must be greater than desired for the reason that there is not sufficient room for both through bolts and other necessary structural features such as ports as, for example, the intake and exhaust ports in a rotary engine, a swirl chamber, a fuel injector or a spark ignition device, or the like.

In some instances, this problem has been overcome through the use of short bolts extending only through one end housing and partially into the center housing. This solution is not altogether desirable in that suitable bosses must be provided in the center housing and accordingly take up valuable space therein.

Other solutions have been proposed as well. For example, in one of the previously identified patents, it is proposed that there be employed an elongated clamp extending between two bolts with one or more button-like structures interposed between approximately the midpoint of the clamp and the end housing so that an appropriate clamping force is applied to the end housing intermediate the bolt locations. While this solution represents an improvement, it is subject to two problems. Due to high localized forces and contact stresses, as well as some unavoidable relative motion between the parts during operation of the mechanism, there is a tendency for fretting or "Brinelling" at the button-like structures. Secondly, large localized forces applied at the button-like structures can overstress the supporting structure of the housing since the forces are not carried by bosses but by structure as ports or the like.

Another proposed solution set forth in the other of the previously identified patent is generally unacceptable because of its bulk.

SUMMARY OF THE INVENTION

It is the principal object of the invention to provide a new and improved means for clamping together, the end and center housings of rotary mechanisms. More specifically, it is an object of the invention to provide new and improved clamping means for clamping the end housings of such mechanisms to the center housing and useful in so-called "crowded areas" adjacent ports or ignition devices or the like whereby high localized stresses are not present and whereby the possibility of undesirable fretting is minimized.

The exemplary embodiment achieves the foregoing object in a typical rotary mechanism including a center housing flanked by a pair of end housings which together define an operating chamber. A rotor is mounted for movement within the chamber. The improved clamping means include at least one elongated clamping bracket having a convex face when unstressed. The convex face is in contact with a side of one of the end housings opposite of the center housing and means are operatively associated with at least one end housing and the center housing and the ends of the clamping bracket for stressing the clamping bracket to bring the convex face thereof into contact with the end housing side along most of the length of the face.

In a preferred embodiment, the stressing means comprise at least two through bolts, one at each end of the clamping bracket. Preferably, the mechanism is assembled such that the ends of the clamping bracket are bottomed out against the side of the end housing.

In a highly preferred embodiment, the clamping bracket has a second convex face opposite from the first convex face for maximum strength. Moreover, the clamping bracket preferably is symmetrical when unstressed for ease of manufacture and to simplify its use when applied to the rotary mechanism during assembly thereof.

Other objects and advantages will become apparent from the following specification taken in connection with the accompanying drawings.

DESCRIPTION OF THE PREFERRED EMBODIMENT

Figure 1:
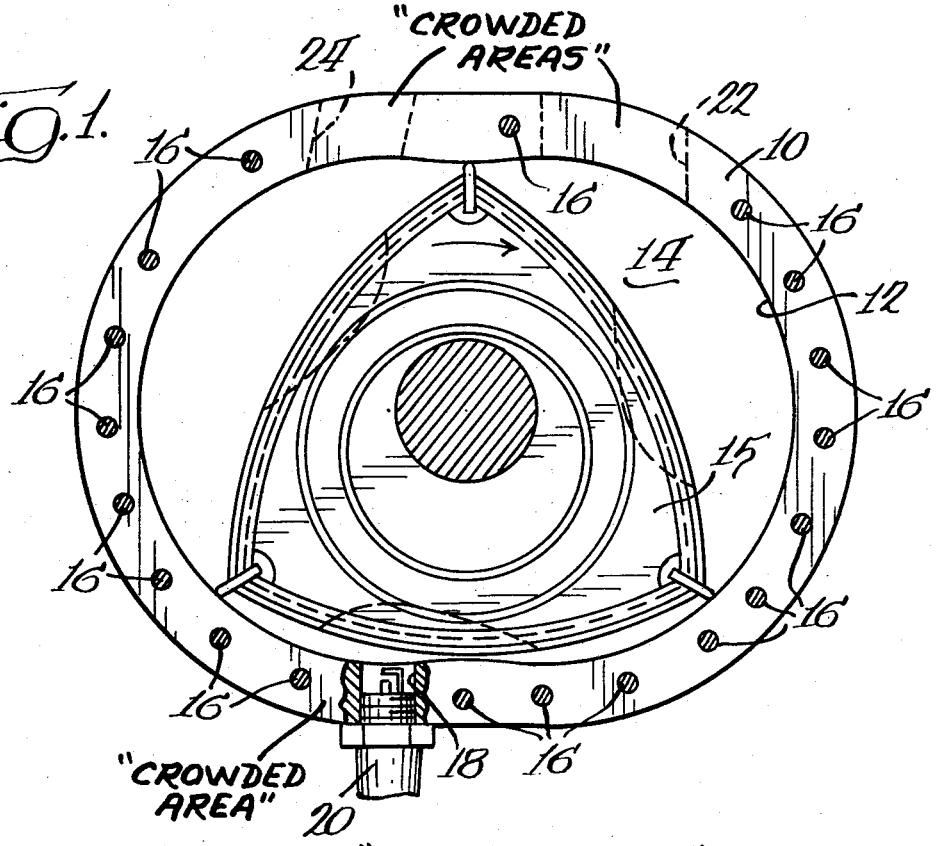
FIG. 1 is a view of a rotary mechanism embodying the invention.

An exemplary embodiment of a rotary mechanism made according to the invention is illustrated in FIG. 1 and is seen to include a trochoidal mechanism, namely, a trochoidal engine of the so-called "Wankel" type. However, it is to be understood that the invention is not limited to rotary engines of any particular configuration. For example, the invention is applicable to pumps, compressors and other forms of rotary mechanisms such as a slant axis rotary mechanism.

The rotary engine includes a center housing 10 having an interior opening 12. The center housing 10 is flanked by a pair of end housings 14 (only one of which is shown). The housings 10 and 14 define an operating chamber receiving a movable rotor 15 in a conventional fashion. Aligned bores extend through the center housing 12 and the end housings 14 for receipt of through bolts 16 in patterns which are typically along the lines of that illustrated in FIG. 1. As can be seen, in the area adjacent a spark plug opening 18 for receipt of a spark plug 20, the spacing of the bolts 16 is considerably greater than in most other instances. The same is true at the locations adjacent an intake port 22 and an exhaust port 24. This undesirably great spacing is, as mentioned previously, necessary so as to enable proper placement of ports such as the ports 22 and 24 and other devices as the spark plug 20. And, because of such spacing, the attendant problems of gas leakage, coolant leakage and structural failure of the housings will occur.

Figure 2:
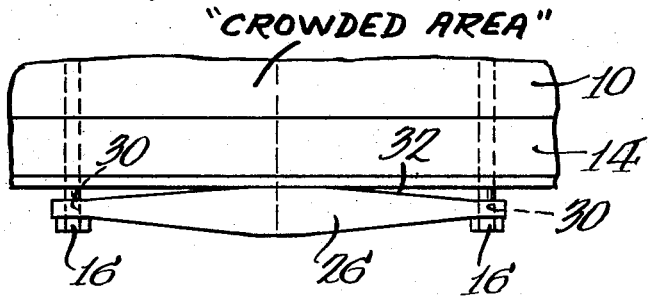
FIG. 2 illustrates the improved clamping means of the invention applied to the rotary mechanism, but in an unstressed state.
Figure 3:
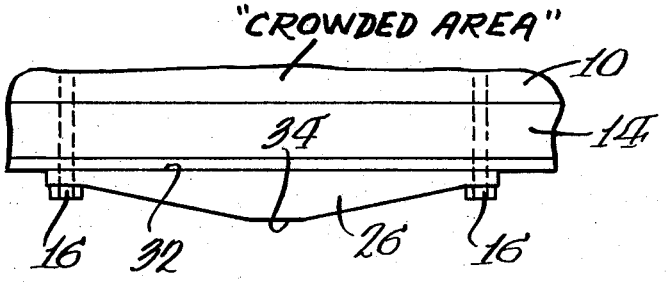
FIG. 3 illustrates the invention finally applied to the rotary mechanism.

Turning now to FIGS. 2 and 3, a clamping means for use in such areas will be described in detail. The clamping means comprises an elongated clamping bracket 26 having bores 30 at its opposite ends for receipt of the through bolts 16. Intermediate its ends, the clamping bracket has a convex face 32 assuming that the clamping bracket 26 is in an unstressed state as is illustrated in FIG. 2. The convex face 32 is brought into engagement with the side of the end housing 14 opposite from the center housing 10 as illustrated.

Through the tightening of the through bolts 16, the clamping bracket 26 may be stressed such that the convex face 32 will be in contact with the side of the end housing 14 along most of the length of the convex face 32. Preferably, substantially all of the face 32 will be brought into such contact. In addition, the through bolts 16 may be further tightened to provide the desired clamping force at their respective locations.

As a consequence, it will be appreciated that the necessary clamping force will be applied relatively uniformly between the bolt locations whereat the clamping bracket 26 is secured. As a result, localized heavy stresses will be minimized since the total clamping force will be distributed over a greater area than in prior art constructions. Structural failure and fretting are, accordingly, essentially eliminated.

Preferably, the clamping bracket 26 is provided with a second convex face 34 opposite from the first convex face 32. By reason of this construction, a number of advantages are obtained. Firstly, at the midpoint of the bracket 26 and that furthest from its point of support by the bolts 16, the clamping bracket will be desirably stronger. Secondly, by appropriately shaping both the faces 32 and 34, any desired force application pattern can be achieved.

Perferably, the clamping bracket 26 is made symmetrical. When such is the case, the manufacture of the bracket 26 itself is simplified. Moreover, when employed in the construction of rotary mechanisms in an assemblyline, its application to the mechanism is simplified by reason of the fact that the laborer need not be concerned whether the face 32 or the face 34 is applied to the side of the engine housing 14. Thus, less manipulation during assembly is required and it is virtually impossible for improper application to occur.

What is claimed is:

1. In a rotary mechanism including at least two housings, means clamping the housings together to define an operating chamber, and a rotor mounted for movement within said chamber, the improvement wherein said clamping means include at least one elongated clamping bracket having a convex face when unstressed, said convex face being in contact with a side of one of said housings opposite of the operating chamber, and means operatively associated with said housings and the ends of said clamping bracket for stressing said clamping bracket to bring said convex face into contact with said side along most of the length of said face.

2. The rotary mechanism of claim 1 wherein said stressing means comprise at least two bolts, one at each end of said clamping bracket.

3. The rotary mechanism of claim 2 wherein said ends are "bottomed out" against said side.

4. The rotary mechanism of claim 1 wherein said clamping bracket has a second convex face opposite from said first convex face.

5. The rotary mechanism of claim 4 wherein said clamping bracket is symmetrical when unstressed.

* * * * *